US008950980B2

(12) United States Patent
Jones

(10) Patent No.: US 8,950,980 B2
(45) Date of Patent: Feb. 10, 2015

(54) SUPPORT PLATFORM FOR AN OIL FIELD PUMPING UNIT USING HELICAL PILES

(71) Applicant: Robert L. Jones, Golden, CO (US)

(72) Inventor: Robert L. Jones, Golden, CO (US)

( * ) Notice: Subject to any disclaimer, the term of this patent is extended or adjusted under 35 U.S.C. 154(b) by 19 days.

(21) Appl. No.: 13/861,181

(22) Filed: Apr. 11, 2013

(65) Prior Publication Data

US 2013/0309024 A1 Nov. 21, 2013

Related U.S. Application Data

(60) Provisional application No. 61/647,400, filed on May 15, 2012.

(51) Int. Cl.
*E02D 5/56* (2006.01)

(52) U.S. Cl.
CPC ..... *E02D 5/56* (2013.01)
USPC ..... 405/252.1; 405/230

(58) Field of Classification Search
CPC ..... E02D 5/56
USPC ..... 405/230, 231, 244, 252.1
See application file for complete search history.

(56) References Cited

U.S. PATENT DOCUMENTS

| | | | | |
|---|---|---|---|---|
| 2,381,014 A | | 8/1945 | Thornley | |
| 2,603,319 A | | 7/1952 | Dyche | |
| 2,881,591 A | | 4/1959 | Reeve | |
| 2,987,892 A | | 6/1961 | Reeve | |
| 3,546,885 A | * | 12/1970 | Pogonowski | 405/227 |
| 3,575,005 A | * | 4/1971 | Sumner | 405/196 |
| 3,878,662 A | | 4/1975 | Cernosek | |
| 4,572,012 A | | 2/1986 | Laney | |
| 6,352,390 B1 | | 3/2002 | Jones | |
| 6,352,391 B1 | | 3/2002 | Jones | |
| 6,578,333 B1 | * | 6/2003 | Gagliano | 52/295 |
| 6,665,990 B1 | | 12/2003 | Cody et al. | |
| 6,682,267 B1 | | 1/2004 | Jones | |
| 6,745,852 B2 | | 6/2004 | Kadaster et al. | |
| 6,817,810 B2 | | 11/2004 | Jones | |
| 7,037,045 B2 | | 5/2006 | Jones | |
| 7,707,797 B2 | | 5/2010 | Henderson | |
| 8,096,732 B2 | | 1/2012 | Brown | |
| 2004/0091322 A1 | | 5/2004 | May | |
| 2007/0163186 A1 | | 7/2007 | Baugh et al. | |

* cited by examiner

*Primary Examiner* — Tara M. Pinnock

(74) *Attorney, Agent, or Firm* — Dorr, Carson & Birney, P.C.

(57) ABSTRACT

A support platform for an oil field pumping unit includes a frame supporting the oil field pumping unit, vertical helical piles, and diagonal helical piles. The vertical helical piles are driven into the ground beneath the frame to support the frame and oil field pumping unit. Each diagonal helical pile has an upper end secured to the frame and a lower portion extending diagonally downward from the frame with a helical blade threaded into the ground to restrain horizontal forces exerted by the oil field pumping unit.

16 Claims, 6 Drawing Sheets

54
60
36
62
44
40
42
50
52
10
32
30
34

SUPPORT PLATFORM FOR AN OIL FIELD PUMPING UNIT USING HELICAL PILES

RELATED APPLICATION

The present application is based on and claims priority to the Applicant's U.S. Provisional Patent Application 61/647,400, entitled "Support Platform For An Oil Field Pumping Unit Using Helical Piles," filed on May 15, 2012.

BACKGROUND OF THE INVENTION

Field of the Invention

The present invention relates generally to the field of support platforms for oil field pumping units. More specifically, the present invention discloses a support platform for an oil field pumping unit that employs diagonal helical piles to carry the horizontal components of dynamic loads associated with operation of the pumping unit.

Statement of the Problem

Oil and gas wells typically include a well head at the upper end of the well bore and casing. The general configuration of a typical well using a "horse head" or "walking beam" pump 14 is shown in FIG. 1. It should be understood that the present invention could be employed in association with a wide variety of conventional pumps, as well as Rotaflex® pumps and other pump designs.

The pumping unit 20 is a large motor that drives the pump 14 to extract oil or gas from the well 12. A typical pumping unit 20 weighs on the order of 150,000 pounds. In addition to this large static load, operation of the pumping unit generates large dynamic loads. The conventional approach has been to mount the pumping unit on a large reinforced concrete pad placed on the ground adjacent to the well head in the general configuration shown in FIG. 1. The concrete pad is usually fabricated at a central facility and must be transported to the well site, which can entail substantial effort, delay and expense.

Proper positioning and alignment of the pumping unit, horse-head pump and well head are critical to proper operation of the well. These components can be initially aligned during installation of the concrete pad and assembly of the well components. However, the concrete pad can gradually settle, shift or tilt over time in response to the static or dynamic loads of the pumping unit, or in response to soil conditions. These factors can cause the pumping unit to move out of alignment with the other well components. Remedying this situation usually requires that the well must be shut down for a period of time, which cuts well production and income. The costs associated with realigning the well components can also be substantial. Therefore, a need exists for a support platform for pumping units that more effectively handles the horizontal dynamic loads generated the pumping unit to minimize shifting or tilting, and also provides a means for readily correcting misalignment of the pumping unit.

Solution to the Problem

The present invention addresses these shortcomings by providing a support platform for pumping units that includes both vertical helical piles to support the static load of the pumping unit, and diagonal helical piles to carry dynamic, horizontal loads. These helical piles also provide a ready means for adjusting the position, tilt or elevation of the support platform to maintain proper alignment of the pumping unit. For example, an elevation-adjustable cap can be attached to the upper end of a helical pile to facilitate leveling or vertical adjustment.

SUMMARY OF THE INVENTION

This invention provides a support platform for oil field pumping units that includes both vertical helical piles to support the static load of the pumping unit, and diagonal helical piles to carry dynamic, horizontal loads.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
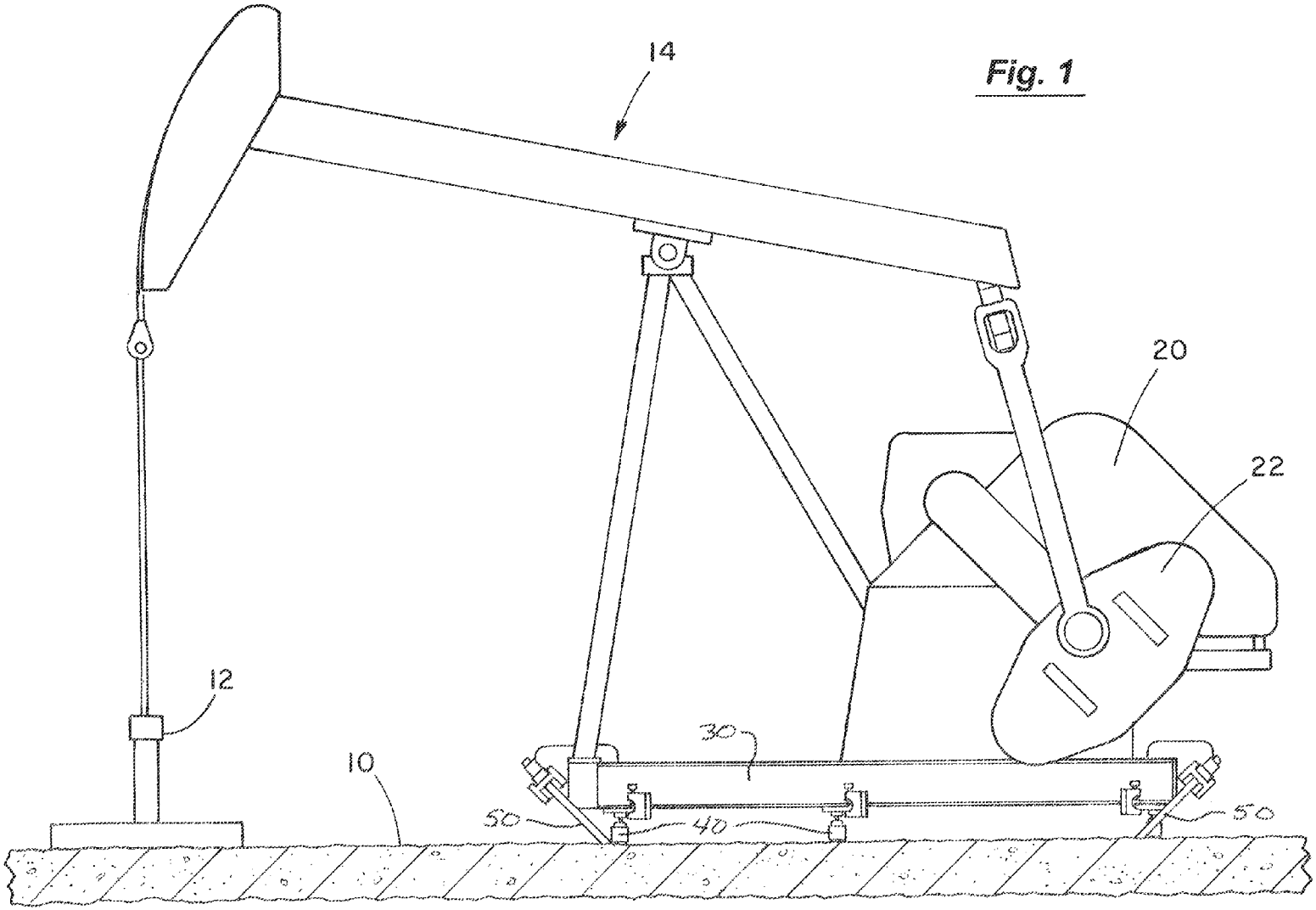
FIG. 1 is a side view of a pump and well head implementing the present invention.

Turning to FIG. 1, a side view is illustrated of a well implementing the present invention. The well typically includes a well bore with a casing extending from the ground 10 to a well head 12. A horse-head pump 14 is driven by the pumping unit 20 to extract oil or gas from the well. A counterweight 22 is also driven by the pumping unit 20 to counterbalance operation of the horse-head pump 14. The horse-head pump 14 and pumping unit 20 are typically aligned along an axis with the well head 12. Operation of the pumping unit 20 can impose substantial dynamic loads, in addition to the static load caused by the weight of the pumping unit 20. These dynamic loads can include large horizontal components parallel to the axis of the horse-head pump 14 and pumping unit 20, as well as smaller lateral loads perpendicular to this axis.

Figures 2, 2A:
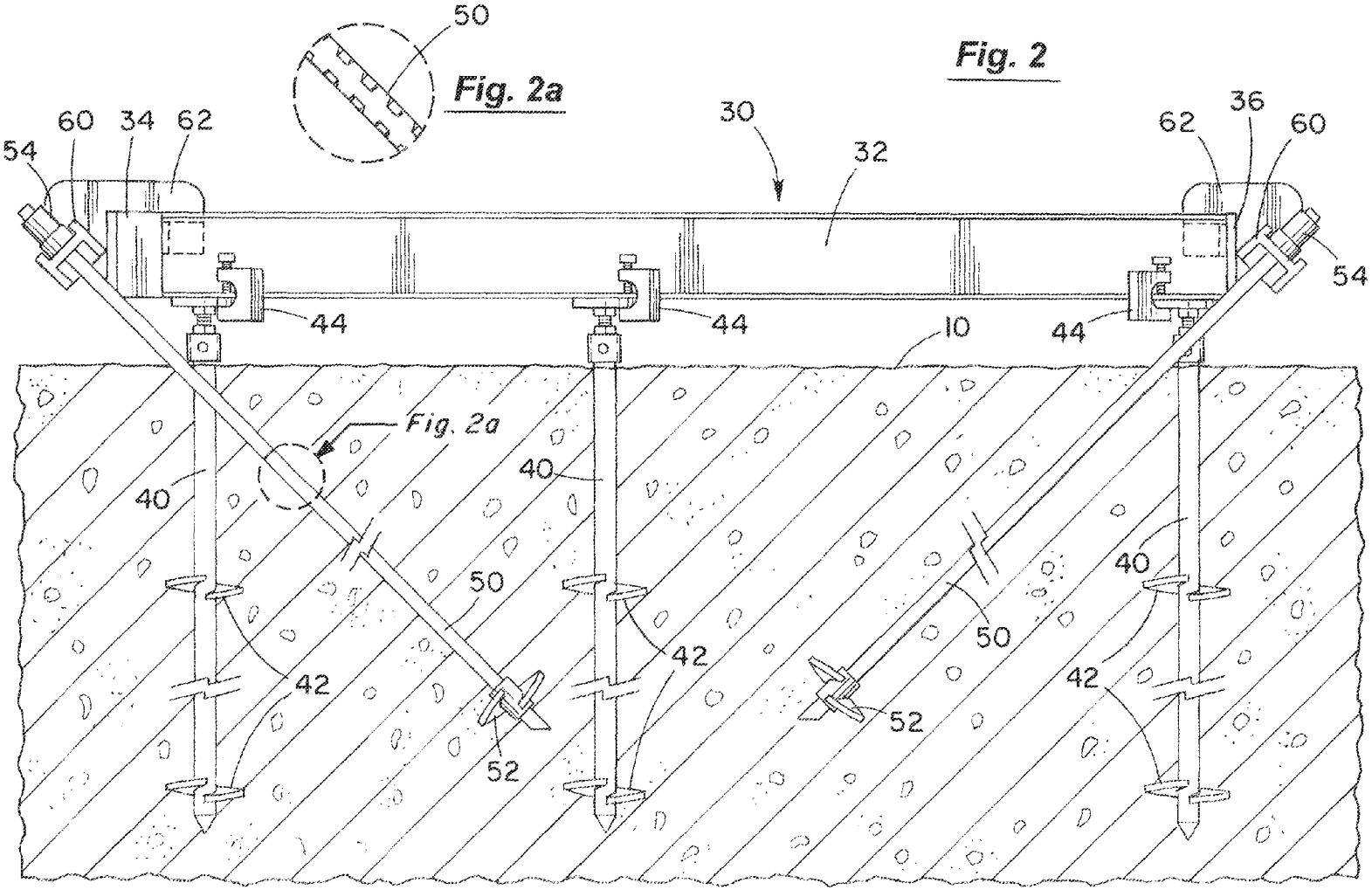
FIG. 2 is a side view of the support platform and helical piles.
FIG. 2*a* is a detail side view of a portion of the shaft of a helical pile.

FIG. 2 is a side view of the support frame 30 and helical piles 40, 50 used to support the pumping unit 20. The support frame 30 can have a rectilinear frame of I-beams and/or plates providing a platform for the pumping unit 20. For example, the embodiment of the support frame 30 shown in the top view illustrated in FIG. 7 has two parallel side beams 32 and two perpendicular end beams or plates 34, 36. The side beams 32 run parallel to the length of the horse-head pump 14 toward the well head 12 (i.e., parallel to the axis of the horse-head pump 14 and pumping unit 20). However, other configurations of the support frame 30 could be readily substituted. The embodiment of the invention shown in the accompanying drawings shows a support frame 30 separate from the pumping unit 20. It should be understood that the support frame 30 could be the base or other integral part of the pumping unit 20. The support frame 30 can be made of concrete, steel or any other suitable material.

The support frame 30 is secured to, and supported by both vertical helical piles 40 and diagonal helical piles 50. The helical piles 40, 50 can be conventional. Each helical pile 40, 50 includes an elongated shaft with a number of helical blades 42, 52 attached near its lower end. The helical blades 42, 52 and the lower portion of the helical piles 40, 50 can be threaded into the ground 10 in a conventional manner, so that the upper end of the helical pile 40, 50 remains exposed and can be attached to the support frame 30.

Optionally, some or all of the shaft of the helical pile can be threaded to allow adjustability in the location of the helical blade, and to enable multiple shafts to be coupled together in series to any desired length, as taught in the applicant's prior U.S. Pat. Nos. 6,352,391, 6,682,267 and 6,817,810. FIG. 2*a* is a detail side view of a portion of the threaded shaft of a helical pile. Alternatively, the helical piles 40, 50 can have a modular, tubular construction as taught in the applicant's prior U.S. Pat. No. 7,037,045.

The vertical helical piles 40 are driven into the ground 10 in a pattern directly beneath the area to be covered by the support frame 30. The support frame 30 can then be attached to the exposed upper ends of the vertical helical piles 40 (e.g., by clamps 44). The number, placement and dimensions of the vertical helical piles 40 is largely a matter of design consideration based on the static, vertical loads imposed by the pumping unit 20 and support frame 30 (i.e., the weight of the pumping unit 20 and support frame 30), dynamic vertical loads arising from operation of the well, and soil conditions. As previously mentioned, an elevation-adjustable cap (not shown) can be attached to the upper end of the vertical helical piles 40 to provide a means for leveling the support frame 30 or adjusting its elevation.

Figure 3:
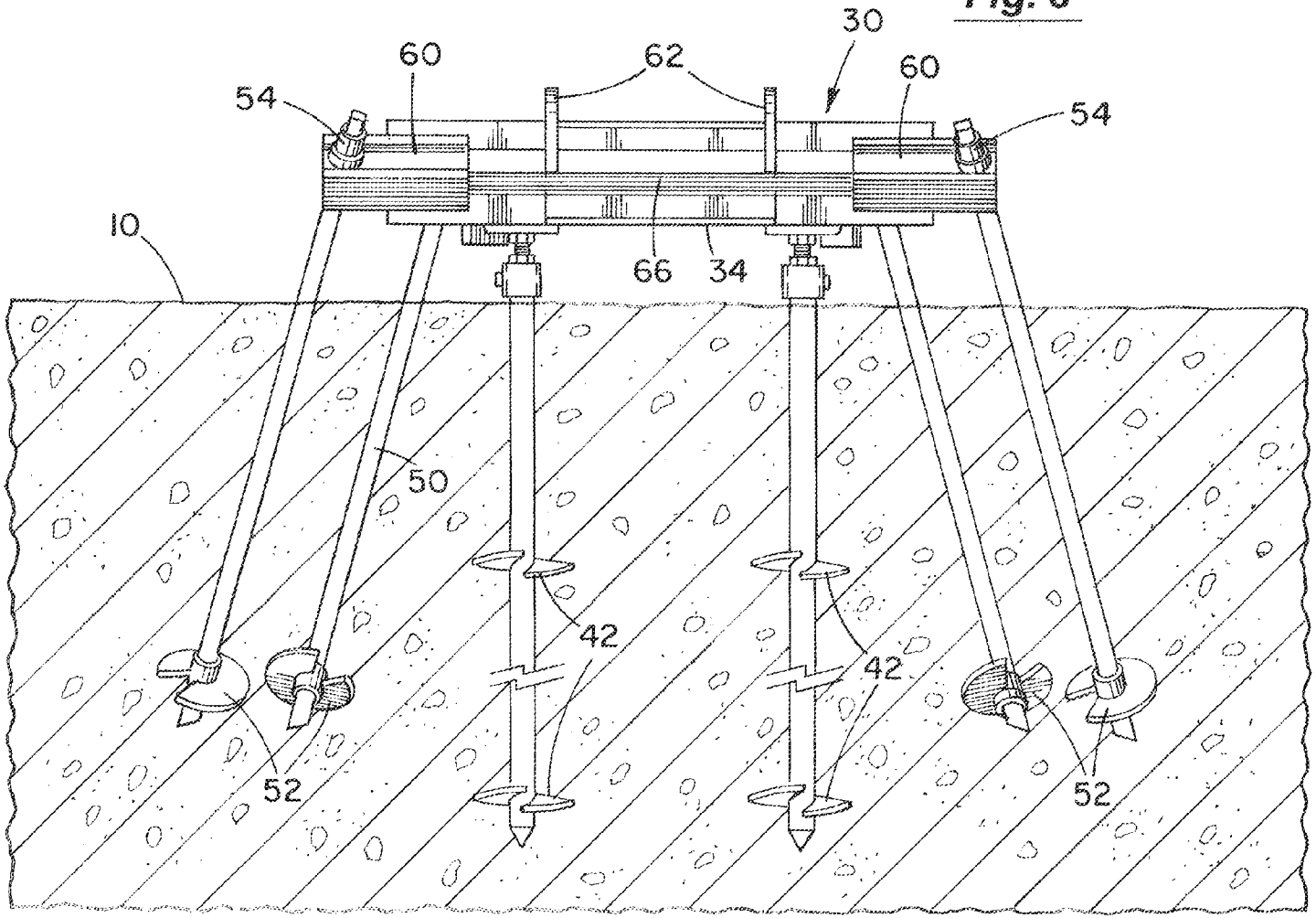
FIG. 3 is a left end view of the support platform and helical piles corresponding to FIG. 2.
Figure 4:
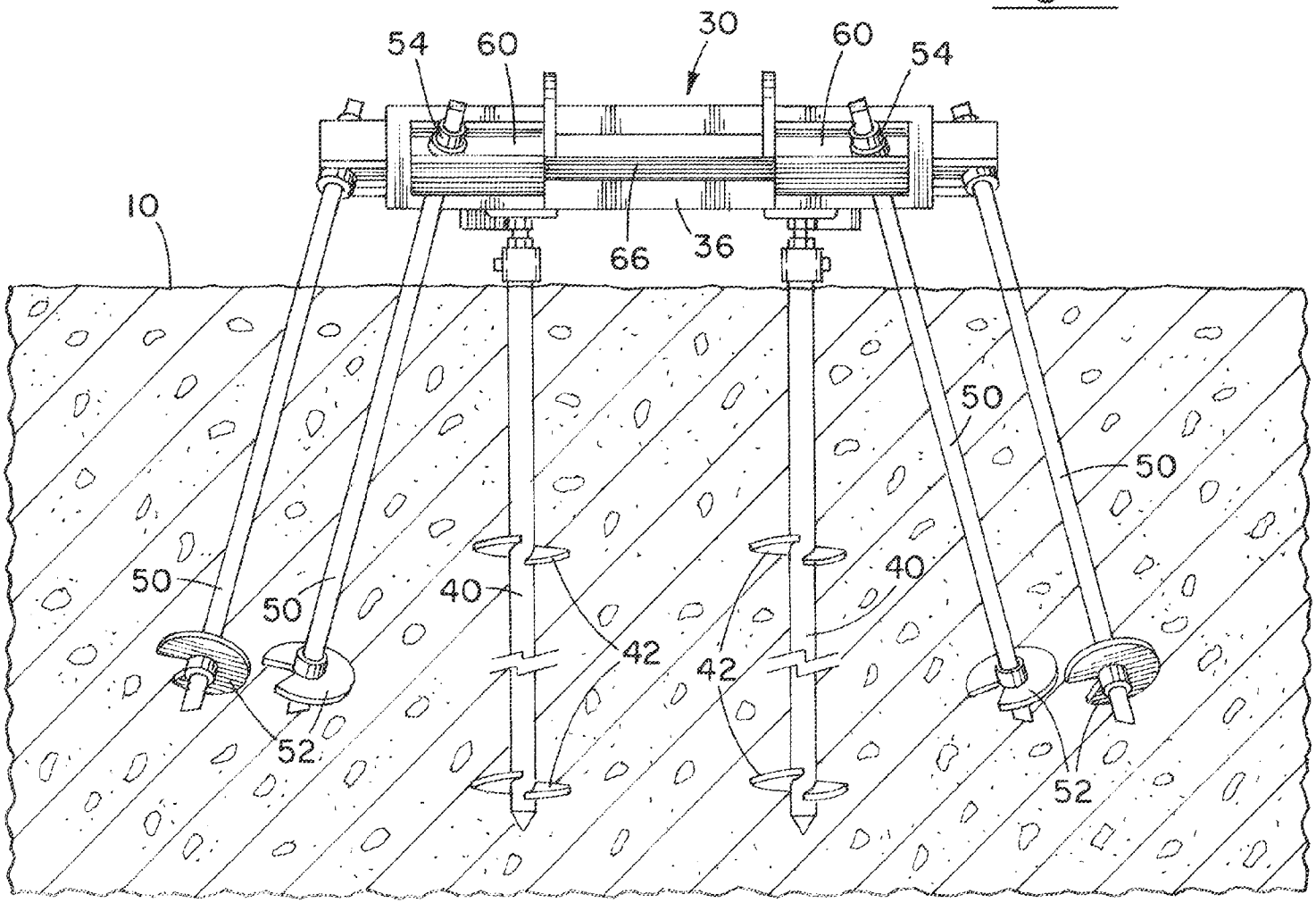
FIG. 4 is a right end view of the support platform and helical piles corresponding to FIG. 2.
Figure 5:
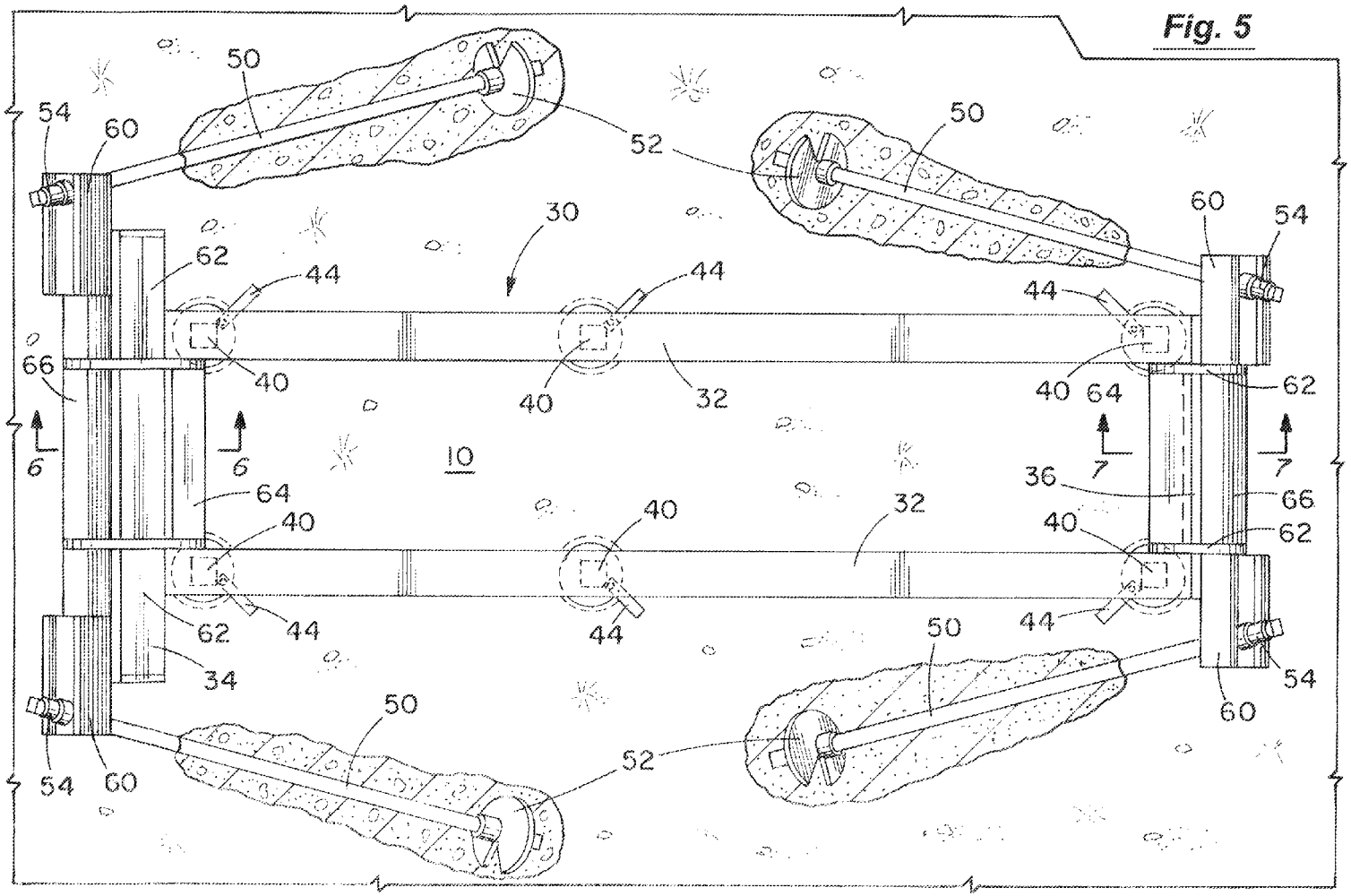
FIG. 5 is a top view of the support platform and helical piles corresponding to FIG. 2.

In addition to the vertical helical piles 40, a number of diagonal helical piles 50 extend downward at angles into the ground 10 from the support frame 30, as shown in FIG. 2. FIGS. 3 and 4 are corresponding left and right end views of the assembly. FIG. 5 is a corresponding top view. These diagonal helical piles 50 are designed primarily to carry the dynamic, horizontal loads created by operation of the pumping unit 20. In other words, the diagonal helical piles having a diagonal component relative to the axis of the horse-head pump 14 and pumping unit 20, as shown in the drawings, to restrain the horizontal forces exerted by the oil field pumping unit. Thus, the diagonal helical piles 50 prevent horizontal movement or shifting of the support frame 30 and pumping unit 20, and thereby help to maintain proper alignment between the pumping unit 20 and the remaining components of the pump and well head 12.

In the preferred embodiment of the present invention, the diagonal helical piles 50 angle downward at about 45 degrees from horizontal. In the embodiment shown in the accompanying figures, the diagonal piles 50 extend downward and toward the midsection of the support frame 30. However, it should be understood that the downward angles of the diagonal helical piles 50 could be reversed so that the diagonal piles extend downward and away from the midsection of the support frame 30. Optionally, the diagonal helical piles 50 can be angled outward relative to the planes of side beams 32 of the support frame 30, as shown in FIGS. 3-5. For example, the diagonal helical piles 50 can be splayed laterally outward by about 15-20 degrees from vertical. This splaying prevents accidental interference with the vertical helical piles 40, and also helps in carrying any incidental lateral forces. These lateral forces are relatively small in comparison to the much larger dynamic loads exerted parallel to the side beams 32 of the support frame 30.

Figure 7:
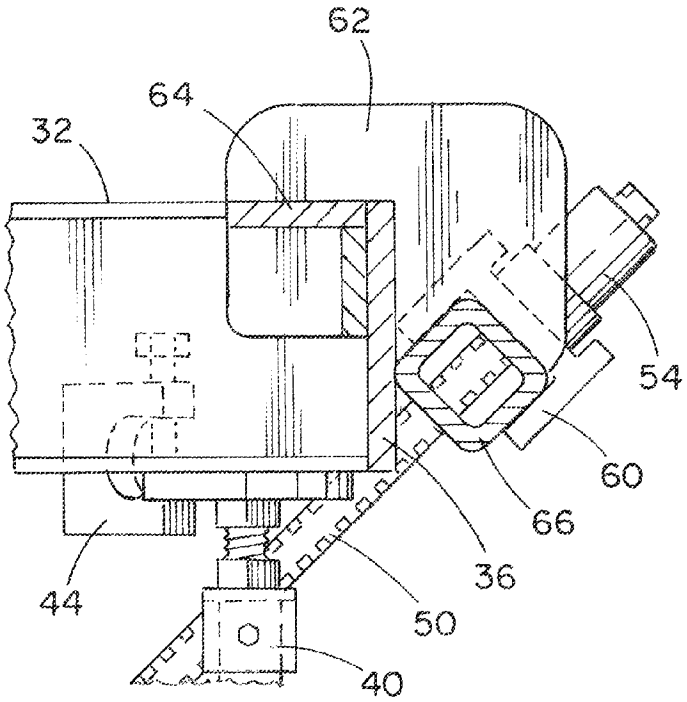
FIG. 7 is a detail cross-sectional view of the right end of the support platform assembly.
Figure 6:
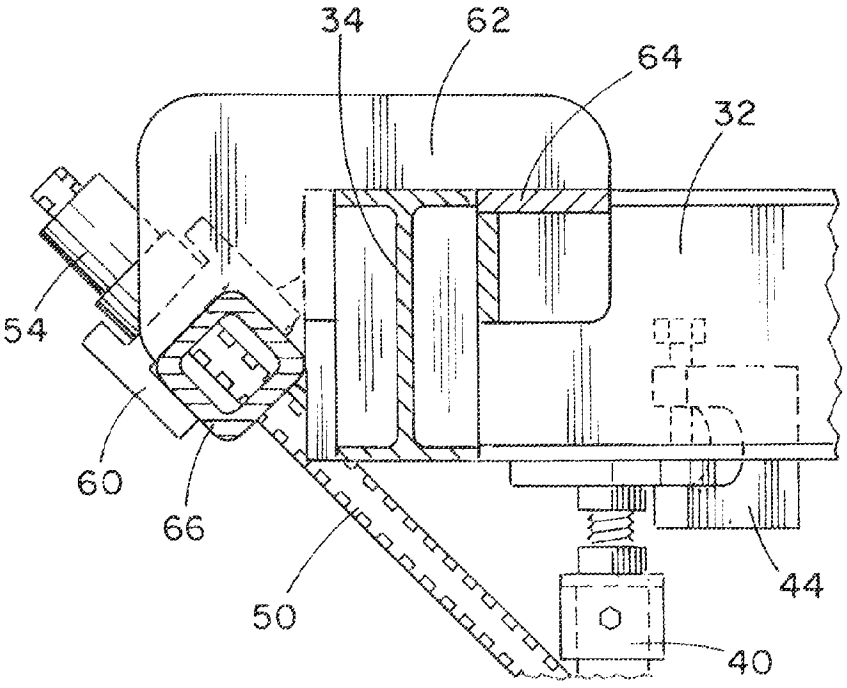
FIG. 6 is a detail cross-sectional view of the left end of the support platform assembly.

End fixtures 60 can be used to removably secure the diagonal helical piles 50 to the ends of the support frame 30 after the diagonal helical piles 50 have been driven into the ground 10. FIGS. 6 and 7 are a detail cross-sectional views of the left and right ends of the support platform assembly, respectively. In this embodiment, the end fixtures 60 include C-shaped vertical members 62 (e.g., C-shaped vertical plates) that fit over the end beams 34, 36 of the support frame 30. A holding plate 64 extends between the distal portions of the vertical members 62 for structural reinforcement. An attachment beam 66 connects the proximal portions of the vertical members 62 and extends laterally outward past the ends of the end beams 34, 36 of the support frame 30, as shown in FIG. 5. The exposed upper ends of the diagonal helical piles 50 pass through openings in the ends of the attachment beams 66, and can be secured by nuts 54.

This configuration greatly simplifies attachment and removal of the support frame 30 and pumping unit 20 from the helical piles. In addition, the diagonal helical piles 50 can be pre-tensioned prior to securing the nuts 54, which helps to counteract the dynamic loads imposed by operation of the pumping unit 20 and thereby further reduce any movement in the support frame 30 during operation of the pumping unit 20.

The preceding disclosure has focused on use of the present invention in supporting oil fielding pumping units. However, there are other potential applications in the oil and gas industries that could benefit from the present invention. For example, compressor stations for natural gas pipelines typically employ a large engine to drive the compressor. These engines are usually mounted on a concrete mats and generate substantial dynamic loads. The present invention could be used in place of a concrete mat to support the engine.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A support platform in combination with an oil field pumping unit, said combination comprising:

a frame supporting an oil field pumping unit and having opposing end beams;

vertical helical piles driven into the ground beneath the frame supporting the frame and oil field pumping unit;

diagonal helical piles, each having an upper end and a lower portion extending diagonally downward from the frame with a helical blade threaded into the ground to restrain horizontal forces exerted by the oil field pumping unit; and end fixtures securing the upper ends of the diagonal helical piles to the end beams of the frame, each end fixture having:

(a) vertical members fitting over the end beams; and (b) an attachment beam connecting the vertical members, and having an opening for receiving the upper end of a diagonal helical pile.

2. The combination of claim 1 wherein the diagonal helical piles are pre-tensioned to counteract dynamic loads imposed by operation of the oil field pumping unit.

3. The combination of claim 1 wherein the oil field pumping unit is aligned along an axis, and wherein the diagonal helical piles are splayed laterally outward from said axis.

4. The combination of claim 3 wherein the diagonal helical piles are splayed laterally outward by about 15-20 degrees.

5. The combination of claim 1 wherein the diagonal helical piles extend diagonally outward from the frame.

6. The combination of claim 1 wherein the diagonal helical piles extend diagonally at about 45 degrees from horizontal.

7. The combination of claim 1 wherein the diagonal helical piles extend diagonally inward from the frame.

8. The combination of claim 1 wherein the vertical members are C-shaped.

9. A support platform in combination with an oil field pumping unit driving a horse-head pump and generating dynamic forces during operation of the oil field pumping unit having horizontal components parallel to an axis defined by the oil field pumping unit and horse-head pump, said combination comprising:

a frame supporting an oil field pumping unit and having opposing end beams;

vertical helical piles driven into the ground beneath the frame supporting the frame and oil field pumping unit;

diagonal helical piles, each having an upper end and a lower portion extending diagonally downward from the frame with a helical blade threaded into the ground, said diagonal helical piles having a diagonal component relative to said axis to restrain horizontal forces exerted by the oil field pumping unit; and end fixtures securing the upper ends of the diagonal helical piles to the end beams of the frame, each end fixture having:

(a) vertical members fitting over the end beams; and (b) an attachment beam connecting the vertical members, and having an opening for receiving the upper end of a diagonal helical pile.

10. The combination of claim 9 wherein the diagonal helical piles are pre-tensioned to counteract dynamic loads imposed by operation of the oil field pumping unit.

11. The combination of claim 9 wherein the diagonal helical piles are also splayed laterally outward from the axis.

12. The combination of claim 9 wherein the diagonal helical piles are splayed laterally outward from the axis by about 15-20 degrees.

13. The combination of claim 9 wherein the diagonal helical piles extend diagonally outward from the frame.

14. The combination of claim 9 wherein the diagonal helical piles extend diagonally inward from the frame.

15. The combination of claim 9 wherein the diagonal helical piles extend diagonally at about 45 degrees from horizontal.

16. The combination of claim 9 wherein the vertical members are C-shaped.

* * * * *